US005345429A

United States Patent [19]

Rebeaud

[11] Patent Number: 5,345,429

[45] Date of Patent: Sep. 6, 1994

[54] ASTRONOMIC TIMEPIECE HAVING A VISIBLE ELEMENT SIMULATING THE DISPLACEMENT OF A STAR

[75] Inventor: Jean-Philippe Rebeaud, Cressier, Switzerland

[73] Assignee: ETA SA Fabriques d'Ebauches, Grenchen, Switzerland

[21] Appl. No.: 521,691

[22] Filed: May 8, 1990

[30] Foreign Application Priority Data

May 8, 1989 [CH] Switzerland ..... 01720/89

[51] Int. Cl.[5] ..... G04B 19/26

[52] U.S. Cl. ..... 368/15; 368/185; 368/190

[58] Field of Search ..... 368/185–199, 368/15–19

[56] References Cited

U.S. PATENT DOCUMENTS 246,061 8/1881 Blair .

FOREIGN PATENT DOCUMENTS 2619298 11/1976 Fed. Rep. of Germany .

2365173 4/1978 France .

657740 9/1936 Switzerland .

*Primary Examiner*—Bernard Roskoski

*Attorney, Agent, or Firm*—Weil, Gotshal & Manges

[57] ABSTRACT

The earth ring (8) bears the lunar disc (9) which pivots in a hollow of the surface (8*a*). On its outer periphery it possesses teeth (17) for driving it from the final wheel set (15) of the stepping transmission gear train (15,24,12). The driving wheel set (12) is activated one step per day from the date wheel. The pinion (20) of the lunar disc (9) is in mesh with the outer teeth (22), normally fixed but which may be displaced by means of the correction arrangement controlled by the stem (30) when it is turned in a predetermined sense. The same correction arrangement also enables one to act on the transmission train (12, 14,15,17). The stem (30) is then driven in a sense opposite to the above which displaces the sliding pinion (36) and enables correction of the position of the lunar disc (9) relative to the earth ring (8) this latter normally effecting a complete rotation in twelve months and the lunar disc (9) a complete rotation in about 29.5 days.

11 Claims, 5 Drawing Sheets

ASTRONOMIC TIMEPIECE HAVING A VISIBLE ELEMENT SIMULATING THE DISPLACEMENT OF A STAR

This invention concerns an astronomic timepiece including a temporal reference with a mechanical output having at least one driving wheel set and a display arrangement exhibiting at least one visible element simulating the displacement of a star.

BACKGROUND OF THE INVENTION

Timepieces of this type are known in the prior art in particular from patent documents CH-627 042, CH-666 980 and EP-0195 742. The last two documents describe timepieces which include several coaxial display elements, each bearing one or several marks which simulate stars describing orbits around the center. In the second document, the center represents the sun and the marks simulate planets, while in the third document the center represents the earth and the moving elements simulate the relative displacements of the sun, of the celestial vault or of the moon relative to the earth.

The driving mechanisms for these different display elements include gear trains, the different wheel sets of which are permanently engaged with one another and are driven in a continuous manner from the hours wheel.

The ratios are such that the duration of the sidereal periods represented: the year, moon phases, etc. are exact with very high precision.

As has been indicated in patent document CH-666 980, timepieces conceived in this manner may not be constructed in order to simulate the epicycloidal displacement of the moon around the earth with the sun as center. Effectively, in this case the complication of the gear trains would require a volume of the timepiece which is not compatible with the dimensions of a portable timepiece.

SUMMARY OF THE INVENTION

The invention thus has as its main purpose to overcome the difficulties of the above-mentioned prior art in providing an astronomic timepiece capable of being constructed within the dimensions of a wrist watch, with a simple driving mechanism for a display arrangement simulating the epicycloidal movement of the moon around the earth with the sun as center.

To this end and in conformity with the invention, the display arrangement comprises a planetary gear train the satellite bearer exhibiting a crown directly or indirectly in engagement with the driving wheel set, this latter being activated step by step each day, the planetary set, which is fixed during normal operation being adapted to be activated in rotation via a correction arrangement, and the satellite mounted for rotation on the satellite bearer being driven by a driving wheel in direct or indirect engagement with the planetary set.

Other characteristics and advantages of the invention will become apparent from reading the following description of a non-limiting embodiment of the invention together with the attached drawings.

DESCRIPTION OF THE PREFERRED EMBODIMENT

In referring to the figures, one sees a timepiece generally designated by reference 1 and comprising a temporal reference having a mechanical output of the standard type for which only the elements different from known elements are described in detail hereinafter.

Figure 1:
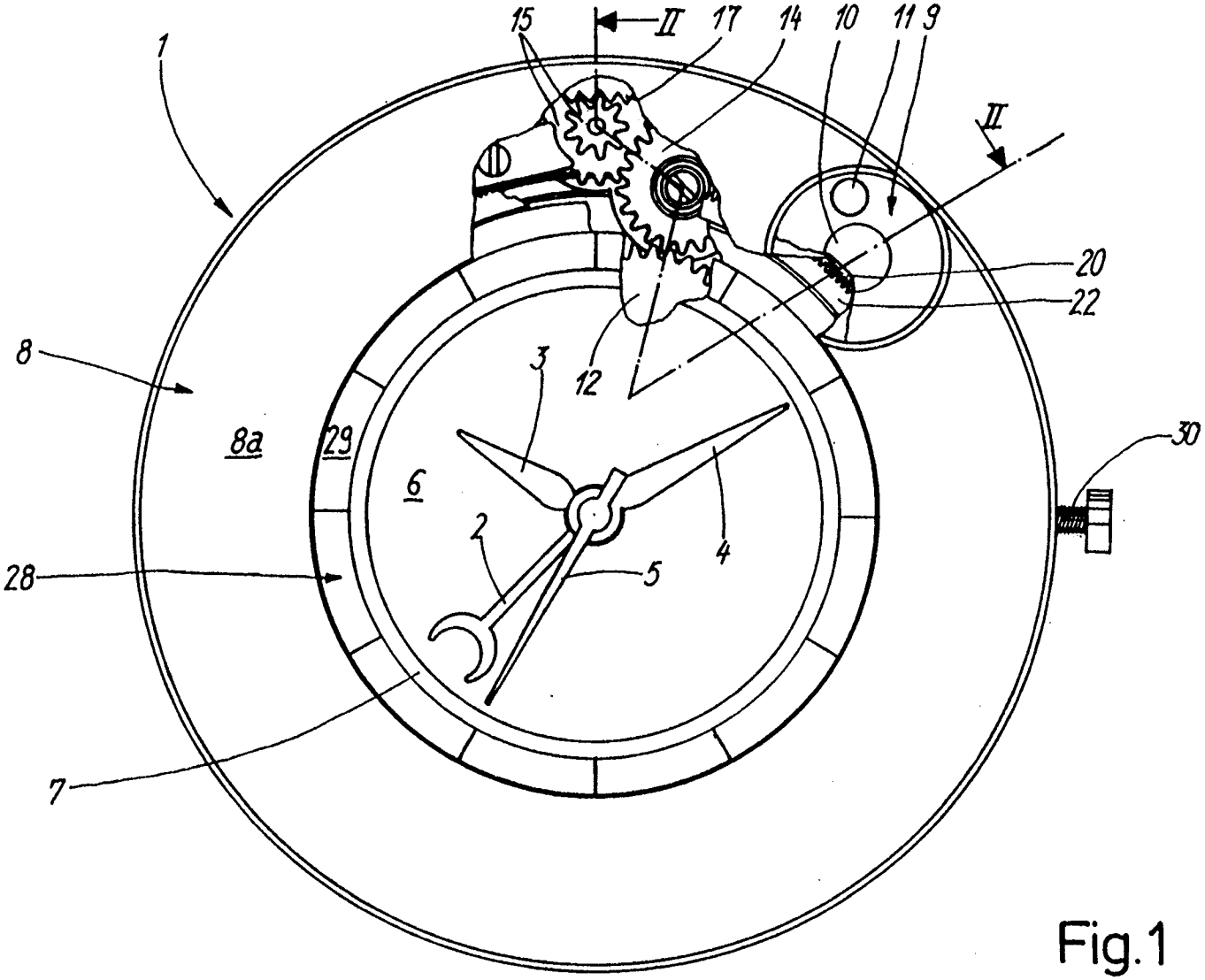
FIG. 1 is a top plan view partially broken away of the timepiece according to the invention.

As appears from FIG. 1, hands 2, 3, 4 and 5 indicating respectively the dates, the hours over twelve hours, minutes and seconds are displaced in a standard manner above a dial 6 through coupling with the temporal reference.

The dates are marked along a graduation provided on a ring 7 on the periphery of the dial 6.

According to the invention, an earth ring 8 is mounted for rotation on dial 6. Ring 8 exhibits an annular surface 8*a* including for example a decoration representing the celestial vault with certain stellar constellations. Furthermore, in one place on the annular surface 8*a*, ring 8 exhibits a circular hollow in which is rotatably mounted a lunar disc 9.

The lunar disc 9 which is coplanar with the annular surface 8*a*, bears a decoration matching this latter and represents in its central portion the terrestrial globe 10 and the moon 11 in the neighborhood of its periphery. It is well understood that the sun is represented here by the center of the dial.

The driving mechanism for elements 8 and 9 will now be described having reference more particularly to FIGS. 1 and 2. A driving wheel set 12 activated step by step each day is mounted on base plate 13. This wheel set 12 is a gear with 31 teeth directly engaged with a standard date wheel not shown on the drawings. The driving wheel set 12 drives a crown 16 provided with interior teeth 17 via transmission gearing including two wheel sets 14 and 15. Crown 16 is fastened to earth ring 8 by means of an annular rib 18 arranged on the face opposite to the annular surface 8*a* of ring 8 and along its external periphery. The interior teeth 17 has 140 teeth and the transmission gearing 14, 15 exhibits a transmission ratio such that the crown 16 (earth ring) effects under normal driving conditions one rotation for 372 steps of the driving wheel set 12. In other words, earth ring 8 effects one rotation for twelve complete rotations of wheel set 12. The wheel set 12 being directly engaged with the date wheel effecting one revolution per month, there results therefrom that the earth ring 8 effects one rotation per year.

In the embodiment particularly described, the driving wheel set 12 will advantageously form the driving wheel set for a months indicator. To this end, the driving wheel set 12 further comprises a driving finger 19, for example of a standard month disc (not shown). Such finger 19 is located in a plane different from that of the wheel as is clearly visible on FIG. 2.

Furthermore, the lunar disc 9 mounted to rotate in the hollow of ring 8 bears on its back side a pinion 20 which meshes directly with the exterior teeth 21 of a ring 22. The form and modulus of teeth 21 are such that in normal operations pinion 20 rolls on these teeth when ring 8 is driven in rotation. The gear ratio of pinion 20 to teeth 21 of ring 22 is such that pinion 20 makes one revolution for approximately 29.5 steps of ring 8. Furthermore, ring 22 comprises crown teeth 23 intended to cooperate with a correction arrangement which will be described in greater detail hereinafter.

The set of elements 8, 9, 20, 17, 22 thus forms a planetary gear train with elements 8, 17 constituting the satellite bearer, elements 9, 20 the satellite, and finally element 22 the planetary wheel set.

Figure 2:
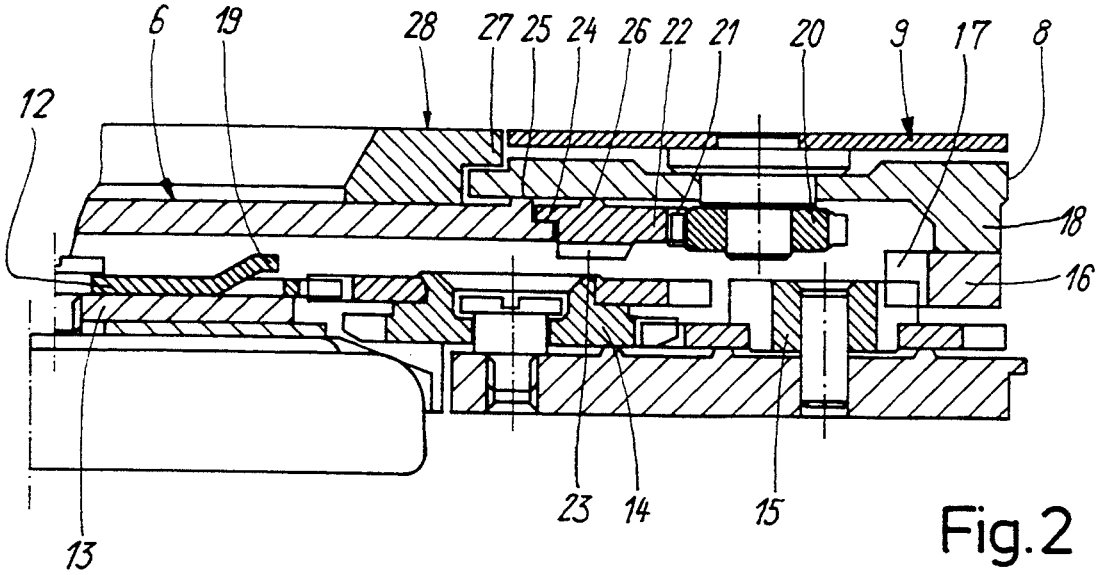
FIG. 2 is a cross-section along broken line II—II of FIG. 1.
Figure 4:
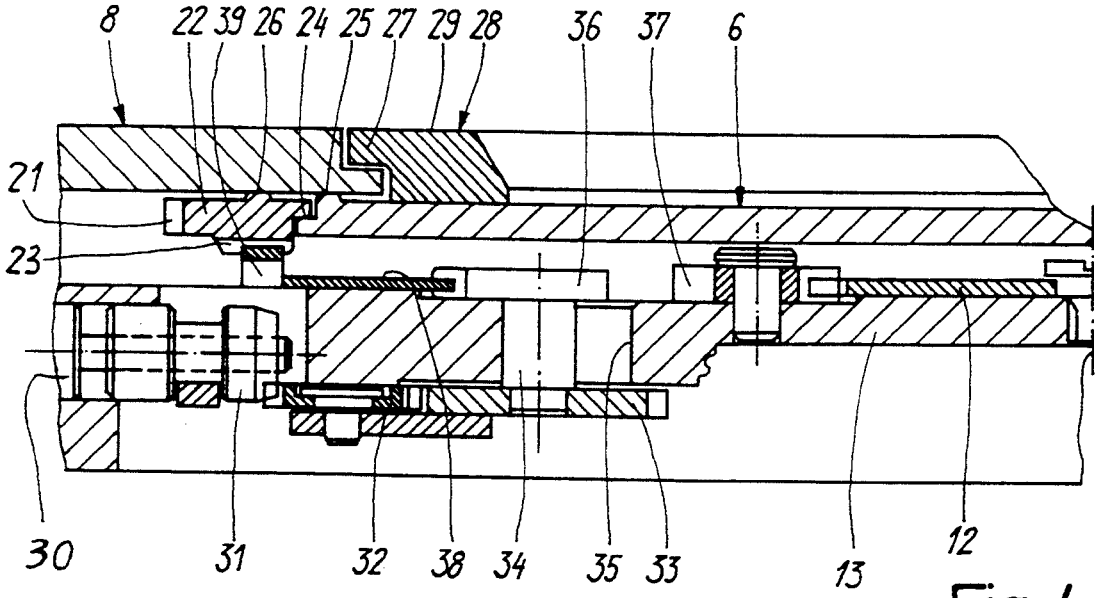
FIG. 4 is a cross-section view along the broken line IV—IV' and IV—IV" of FIG. 3 showing the correction mechanism in the operating position of FIG. 3.

By referring particularly to FIGS. 2 and 4, one sees that ring 22 is supported and guided by an interior annular flange on a shoulder 24 arranged at the periphery of dial 6 and is retained by ring 8. This latter has its edge guided between two planar ribs 25, 26 and a collar 27 of a retaining ring 28 fixed to the dial 6. Ribs 25 and 26 are respectively arranged on the edge of the dial and on the face opposite the crown teeth of ring 22. The retaining ring 28 is secured by appropriate means such as screws or the like (not shown) to dial 6 and exhibits an annular surface 29 coplanar with that 8*a* of earth ring 8. This surface may be advantageously employed to indicate the dates or, for example, be divided into twelve sectors each representing a month of the year and cooperating with an index borne by earth ring 8 so as to indicate the current month.

The timepiece according to the invention also comprises a correction arrangement adapted to correcting the relative positions of the different indicating elements and in particular that of the earth ring 8 and that of the lunar disc 9.

This arrangement, seen on FIGS. 3, 4, 5 and 6, includes a manipulating element constituted by a stem 30. Stem 30 is axially movable between several positions designated by N, CI and CH on FIG. 3.

In a first position designated by N, the stem is completely pushed in in the sense of arrow F1. This position corresponds to normal operation of the timepiece and none of the indicators may then be corrected.

A second position of the stem designated by CH corresponds to the completely withdrawn position going in the sense of arrow F2. This position enables correction of hours, minutes and dates by simple rotation of the stem in the standard manner.

Finally, a third position of the stem designated by CI is intermediate between the first (N) and the second (CH) position. Rotation in a first sense (A) of the stem then enables correction of the lunar disc 9 and in a second sense (B) correction of the earth ring 8.

The correction arrangement further comprises a sliding pinion 31 having axial displacements inverted relative to those of stem 30. When the latter is in position CI, the sliding pinion meshes with an intermediate wheel 32 which cooperates with the pinion 33 of a pivoting lever 34 movable between two end positions in an oblong hole 35 arranged in base plate 13. Moreover, this pivoting lever comprises a disc with three wings 36 which, in the first end position (shown on FIGS. 3 and 4) activates a spring loaded lever 38 comprising a tongue 39 engaged with the crown teeth 23 of ring 22. In the second end position (shown on FIGS. 5 and 6), the disc with three wings meshes with an intermediate wheel 37 directly engaged with the driving wheel set 12.

Figure 3:
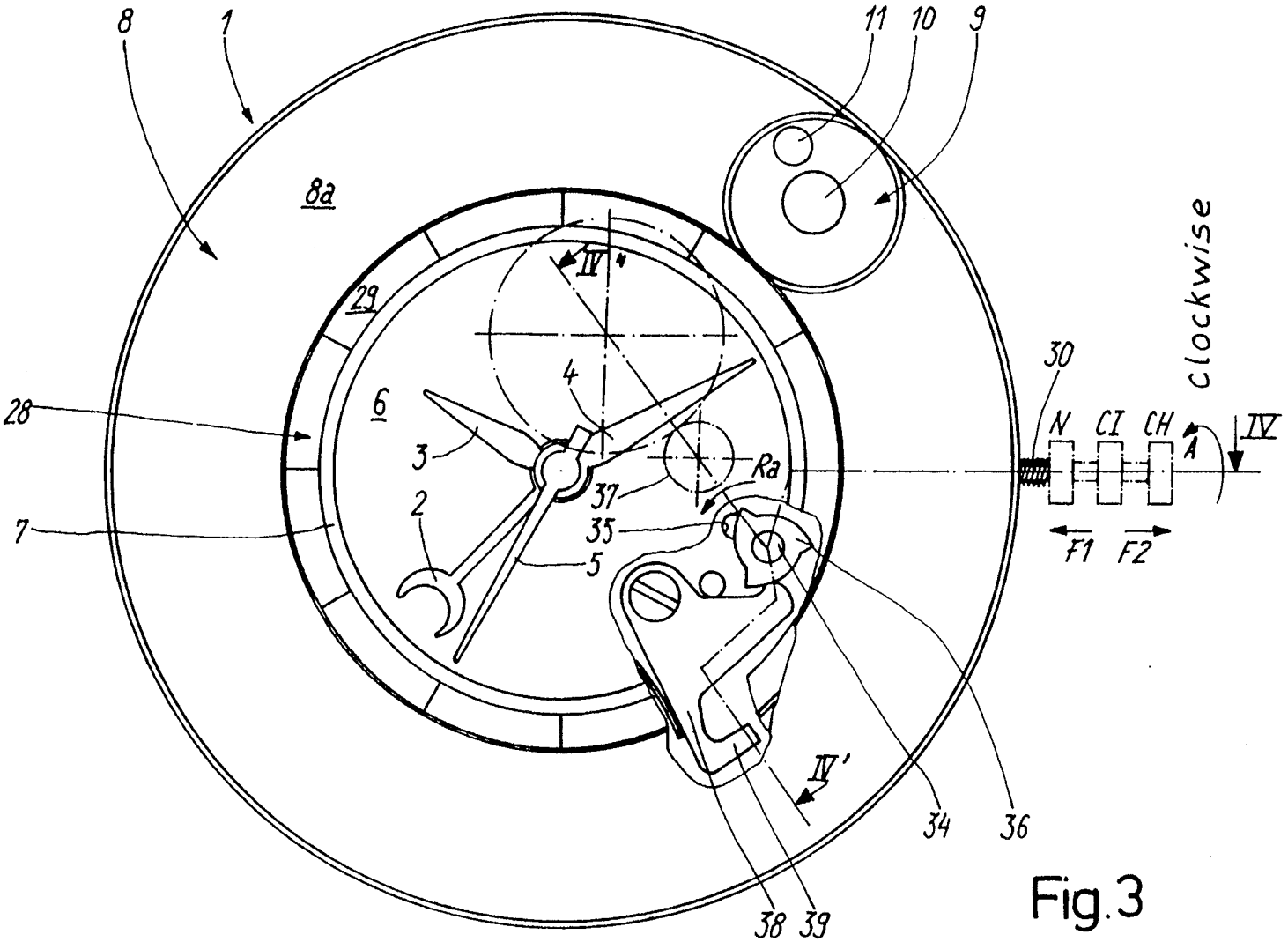
FIG. 3 is a top plan view, partially broken away, and showing the correction mechanism in a first operating position.

The operation of the correction arrangement when the stem is in the correction position CI of the earth ring 8 and of the lunar disc 9 is as follows:

When stem 30 (drawn into the intermediate position CI) is rotated in the sense designated by arrow A, the pivoting lever 34 is rotated in the sense of the arrow Ra and is displaced in the oblong hole 35 into the first end position shown on FIGS. 3 and 4. At this instant, the wings on disc 36 activate lever 38 which, via its tongue 39, drives in rotation ring 22 slidingly mounted on shoulder 24 of dial 6. Ring 22, directly engaged with the pinion drives lunar disc 9 in rotation, the earth ring 8 being retained by gearing 15, 16. Thus, the position of the lunar disc is corrected independently of the position of earth ring 8.

Figure 5:
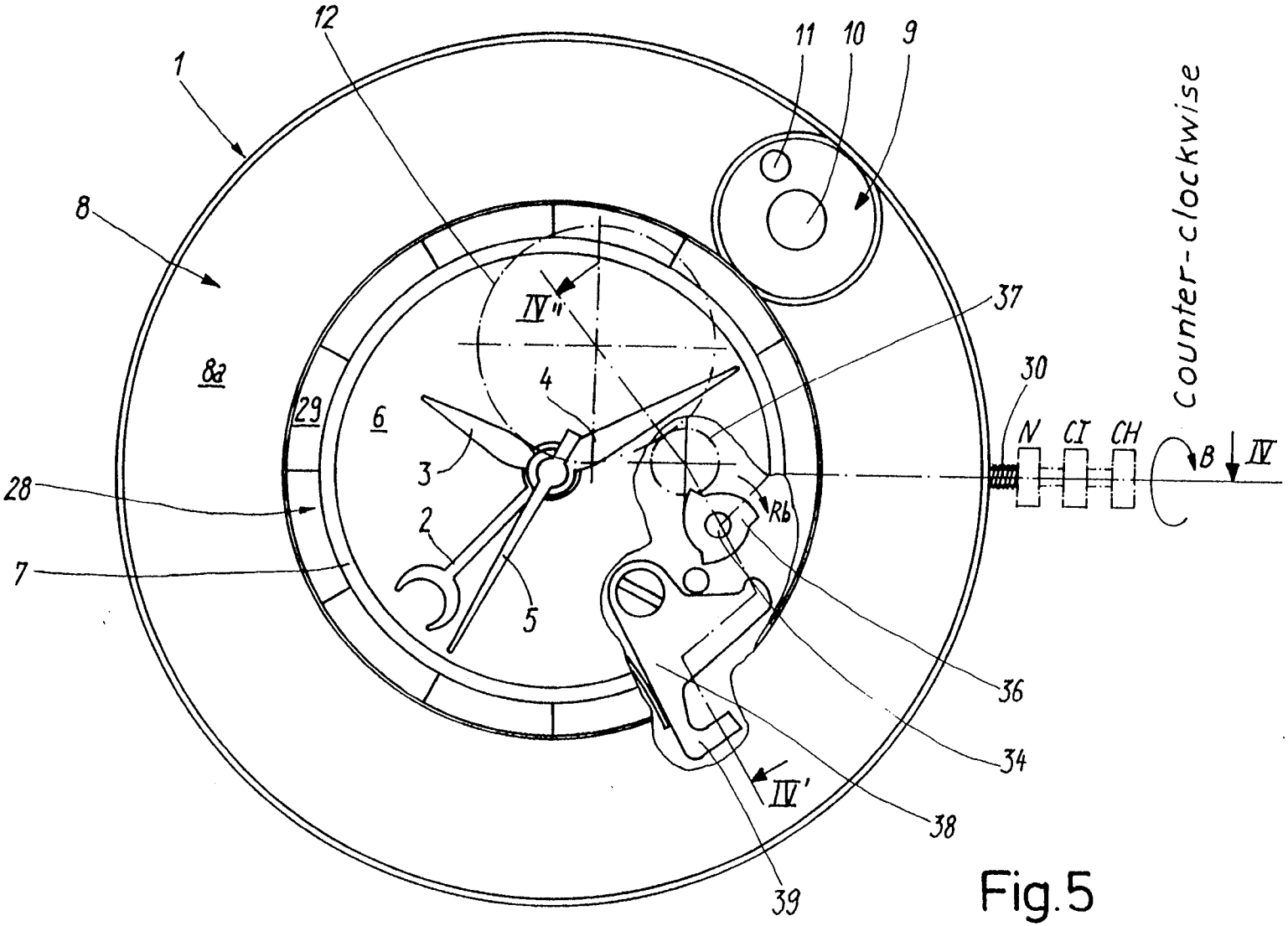
FIG. 5 is a top plan view partially broken away showing the correction mechanism in a second operating position.
Figure 6:
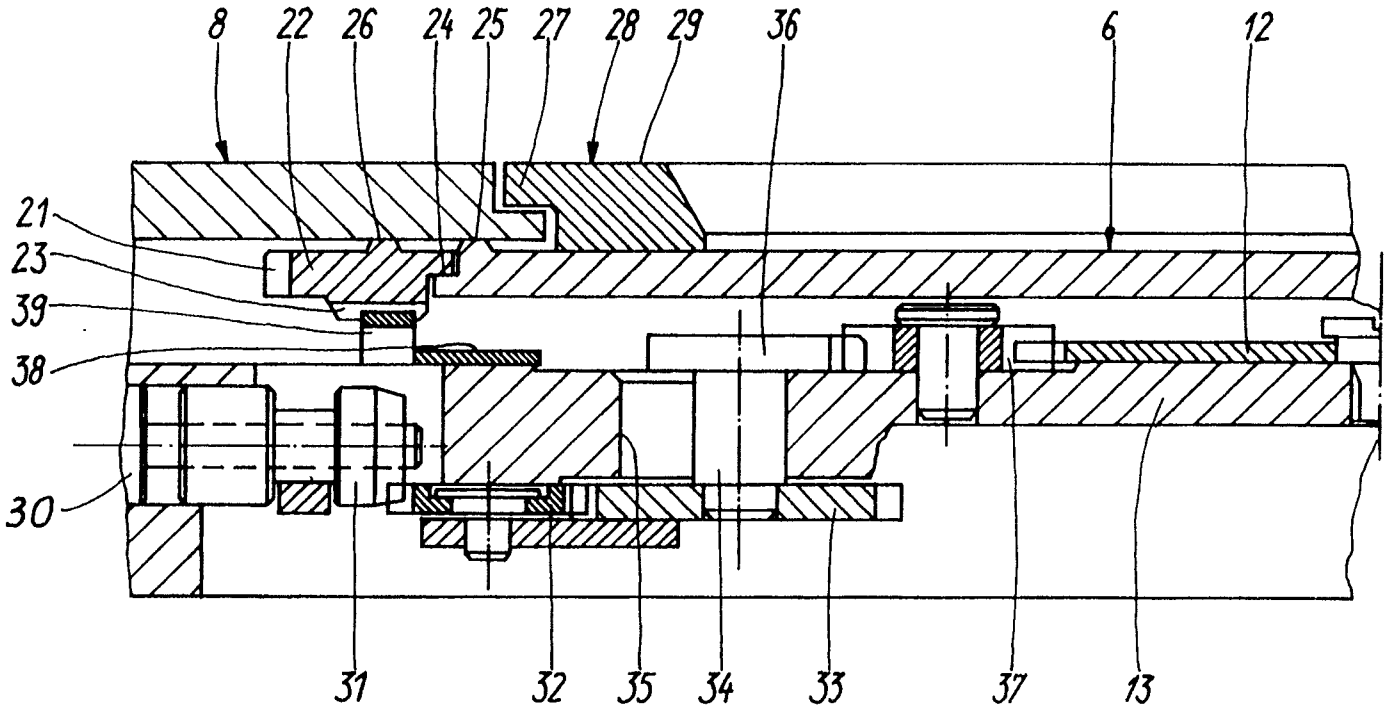
FIG. 6 is a cross-section view similar to that of FIG. 4 showing the correction mechanism in the second operating position of FIG. 5.

On the other hand, when stem 30 is rotated in the sense designated by arrow B of FIG. 5, the pivoting lever 34 is rotated in the sense of arrow Rb and is displaced in the oblong hole so as to occupy the second end position represented on FIGS. 5 and 6. In this position, the disc having three wings 36 meshes with intermediate wheel 37 directly engaged with the driving wheel set 12 which, via the transmission gearing 14, 15, 16 drives the earth ring 8 and enables correction of its position.

One thus obtains a very simple, unemcumbering mechanism which simulates the epicycloidal displacement of the moon around the earth, the latter turning about the sun. Driving occurs step by step once per day. The setting of the timepiece must be effected at the same time as that of the date indicator, i.e. five times per year at the end of months having 31 days (stem in position CH). It is then necessary to correct the position of the moon which is effected just as simply as that of the date by means of the same stem 30 (position CI) by actuating ring 22 as described hereinabove.

The mechanism as described indicates months by the position of the earth in its orbit and enables estimating the phase of the moon.

It will be noted that in a variant of the embodiment the driving ratio of the satellite 9, 20 could be chosen in a manner such that the satellite indicates weeks.

One will also note that in another configuration of the movement, the teeth 17 could be directly driven by a driving wheel set and pinion 20 could be indirectly engaged with the teeth of the planetary set 22.

As is well understood, the mechanism as described could also in other forms, display other astral or terrestrial periods.

What I claim is:

1. An astronomical timepiece including a temporal reference with a mechanical output having a driving wheel set and a display arrangement including at least one visible element simulating the displacement of a star, wherein the display arrangement comprises a planetary gear train, comprising a satellite bearer having a crown gear, said crown gear being driven by the driving wheel set, a ring, a driving wheel, and a satellite mounted for rotation on the satellite bearer and connected to said driving wheel, said driving wheel directly or indirectly meshing with said ring, said ring being fixed in normal operation, the timepiece further including a correction arrangement, said correction arrangement including a control stem positionable in a correction position, the rotation of said control stem when in said correction position in one sense driving the driving wheel set and in the other sense driving said ring.

2. A timepiece as set forth in claim 1 further comprising a month-driving wheel set rotating through one step each day, the driving wheel set and the month-driving wheel set having a common drive.

3. A timepiece as set forth in claim 2 wherein the driving wheel set and the month-driving wheel set together comprise a single wheel, this latter having thirty one teeth and including a driving finger arranged in a plane different from the plane of the wheel.

4. A timepiece as set forth in claim 1 comprising a transmission train between the driving wheel set and the crown gear of the satellite bearer, the transmission ratio being such that the satellite bearer advances by 1/372 revolution at each step of the driving wheel set.

5. A timepiece as set forth in claim 1 wherein the gearing ratio of the planetary gear train to the driving wheel is determined so that the satellite effects one revolution in about 29.5 days.

6. A timepiece as set forth in claim 1 wherein the satellite bearer includes a planar ring arranged at the periphery of the dial, such ring having a visible annular surface and wherein the satellite includes a disc having a visible surface flush with the annular surface and bearing in its center a mark simulating the earth and on its periphery a mark simulating the moon, such latter mark being given an epicycloidal movement.

7. A timepiece as set forth in claim 1 further including an intermediate plate, wherein the satellite bearer comprises interior teeth provided along the periphery of said crown gear and wherein the planetary gear train comprises a ring mounted for rotation on a shoulder of said intermediate plate, the ring having exterior teeth with which the driving wheel meshes and, crown teeth engaged with a driving element of the correction arrangement.

8. A timepiece as set forth in claim 7 wherein the intermediate plate is constituted by the dial.

9. A timepiece as set forth in claim 1 wherein said correcting arrangement further includes a spring biased lever having an elastic tonque and said ring includes crown teeth, and wherein the correction arrangement includes a stem, a rotatable pivoting lever operated by said stem, said pivoting lever when rotated in one rotation sense engaging an intermediate wheel meshing with the driving wheel set and, when rotated in the other rotation sense activating said spring biased lever for causing said elastic tongue to rotate said ring by means of the crown teeth.

10. A timepiece as set forth in claim 9 further comprising a month-driving wheel set rotating through one step each day, the driving wheel set and the month-driving wheel set having a common drive.

11. A timepiece as set forth in claim 10 wherein the driving wheel set and the month-driving wheel set together comprise a single wheel, this latter having thirty one teeth and including a driving finger arranged in a plane different from the plane of the wheel.

* * * * *